United States Patent [19]

Nield

[11] 4,399,423

[45] Aug. 16, 1983

[54] MINIATURE ELECTRIC CIRCUIT PROTECTOR

[75] Inventor: Joseph G. Nield, Cumberland, R.I.

[73] Assignee: Texas Instruments Incorporated, Dallas, Tex.

[21] Appl. No.: 363,187

[22] Filed: Mar. 29, 1982

[51] Int. Cl.[3] ..... H01H 61/02

[52] U.S. Cl. ..... 337/102; 337/107

[58] Field of Search ..... 337/102, 103, 105, 107

[56] References Cited

U.S. PATENT DOCUMENTS

| | | | |
|---|---|---|---|
| 4,015,229 | 3/1977 | Senor et al. | 337/102 X |
| 4,086,558 | 4/1978 | Pejouny et al. | 337/102 |
| 4,136,323 | 1/1979 | D'Entremont et al. | 337/107 |

*Primary Examiner*—George Harris

*Attorney, Agent, or Firm*—John A. Haug; James P. McAndrews; Melvin Sharp

[57] ABSTRACT

A miniature motor protector particularly suitable for low current applications has a generally rectangular parallelepiped configured metallic housing open at the top having a bottom wall and side walls extending upwardly therefrom, the side walls having a flange forming a ledge portion at their free ends extending around all four sides with at least two opposed flanges have an extended portion to permit them to be bent to clampingly engage an element received on the ledge. An electrically insulative gasket is disposed on the ledge with a plate-like element having a selected electrical resistance placed on top of the gasket. The extended flange portions are bent over the gasket and plate-like element to clampingly engage them. The plate-like element is formed with a first switch element mounting portion, a second heater portion and a third support portion adapted to engage the ledge on all four sides. A second switch element is mounted on the bottom wall of the housing with one of the switch elements including a cantilever mounted snap-acting thermostatic member adapted to move into and out of engagement with the other of the switch elements upon selected thermal conditions of the thermostatic member.

15 Claims, 11 Drawing Figures

MINIATURE ELECTRIC CIRCUIT PROTECTOR

The present invention relates generally to devices used to protect electrical equipment such as motors from fault conditions and more particularly protectors to be used with low current equipment.

Over the years there has been a consistent trend in making electrical equipment more and more compact as well as in cost reducing the equipment by using less expensive materials and components. This has had the beneficial effect of increasing the market for such equipment by minimizing price escalation and in many cases by actually decreasing prices. Following this trend there has been a need to produce efficient, effective, and reliable devices which are less expensive and smaller in size to protect such equipment.

In a typical automobile, for example, there may be many small, low current motors to perform such functions as automatic door locking, windshield wiping, antenna movement, movement of headlight covers and so on. These are generally very small, low current devices which require miniature motor protectors which will reliably disconnect the motors from the power source in the event of a fault condition before the motor is damaged as a result of overheating. Such overheating can occur within a matter of seconds; for example in the case of members exposed to the environment outside the car when they are prevented from moving due to air blockage or the like resulting in a locked rotor condition of the motor, so that a requirement of suitable protectors is that they open or disconnect the circuit upon drawing current in excess of a selected value within a very consistent narrow range of times. For example protectors for one type of small automotive motor should disconnect the motor from the power source within a time period of between 3 and 6 seconds (referred to as "on" time) upon the occurrence of a locked rotor condition to avoid damage to the motor which could occur in as little as 10 seconds or less.

Miniature motor protectors comprising a small housing in which is disposed an electrical switch including a small current carrying thermostatic disc adapted upon the occurrence of certain thermal conditions to snap into and out of engagement with a stationary contact to respectively close and open an electrical circuit are available which are very reliable and inexpensive however in order to make them quickly responsive to very small current levels, it is necessary to provide a supplemental heater mounted in heat transfer relation with the disc. An example of this type of protector is described and claimed in U.S. Pat. No. 3,622,930 assigned to the assignee of the present invention. In this case a heater is mounted inside the housing of the protector which in turn mounts the disc in good heat transfer relationship therewith. However one of the problems associated with this type of device is that the position of the fixed end of the disc tends to change slightly changing the calibration of the disc. In devices of the type described a shift of as little as 0.002 inch can take the device completely out of the calibrated range. Since the heater element forms a structural component in determining the location of the disc relief of inherent stresses and the like in the heater element upon heating can cause slight warpage with the result that the location of the disc mount can be concomittantly changed. Other examples may be found in U.S. Pat. Nos. 4,136,323 and 4,224,591. In these patents heaters are disposed externally of the housing of the protector. These provide a desirable relatively long off time, i.e. the time required for the disc to cool off sufficiently to snap back to a circuit engaging position, since the housing acts as a heat sink and supplies heat to the disc even after the disc has snapped to a circuit disengaging position. This relatively long off time which may be on the order of 1½ to 2 minutes is generally desirable to ensure that motor being protected has had a chance to cool off before any damage occurs. However, due to the fact that the heater is mounted externally of the can in a location relatively remotely from the disc the "on" time tends to be longer than desired for many applications. Additionally, due to the remoteness of the heater from the disc the time from device to device is not as consistent as desired. In other words, the spread or range of "on" time for a group of devices instead of being in the 3-6 second range may have a significantly wider band.

In the present invention the heater is fashioned from a plate-like element having a first portion mounting a portion of the switch, either the stationary contact or the thermostatic disc, a second portion formed into a selected heater configuration such as a serpentine shape having one or more loops extending from ledges formed on opposite sides of the housing and a third mounting portion adapted to be supported by a ledge formed on all four sides of a parallelepipedly shaped housing. An electrically insulative gasket is disposed between the plate-like element and the housing ledge to electrically separate the two. A window formed in the gasket receives either the stationary contact or the mount for the thermostatic member with heat being transferred to the disc primarily conductively respectively through the stationary contact or the mount for the thermostatic member. In another embodiment the window is enlarged so that heat is transferred to the thermostatic member radiationally as well as conductively. By selecting the type of heat transfer a wide degree of control over both the "on" and "off" time can be obtained.

It is therefore an object of the present invention to provide a miniature, low cost protector particularly suitable for low current applications, a protector which has consistent, short "on" times yet one which also has relatively long "off" times. Another object is to provide a protector which can be used with existing motor starting relays, either electromechanical or solid state (positive temperature coefficient resistor type) and can even be packaged therewith in a common housing if so desired.

Other objects, advantages, and details of the novel and improved electrical circuit protector device of this invention appear in the following detailed description of preferred embodiments of the invention, the detailed description referring to the drawings in which.

Figure 1:
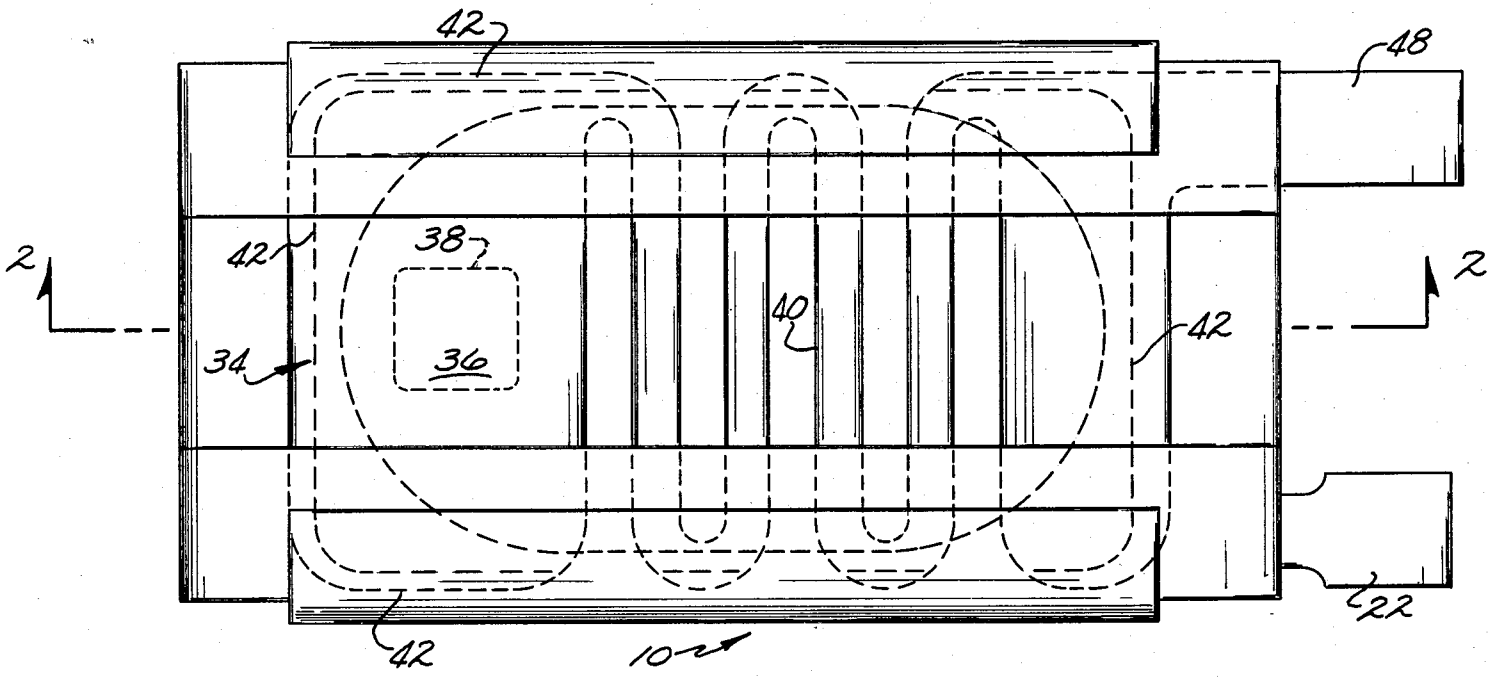
FIG. 1 is a top plan view of the protector of this invention.
Figure 2:
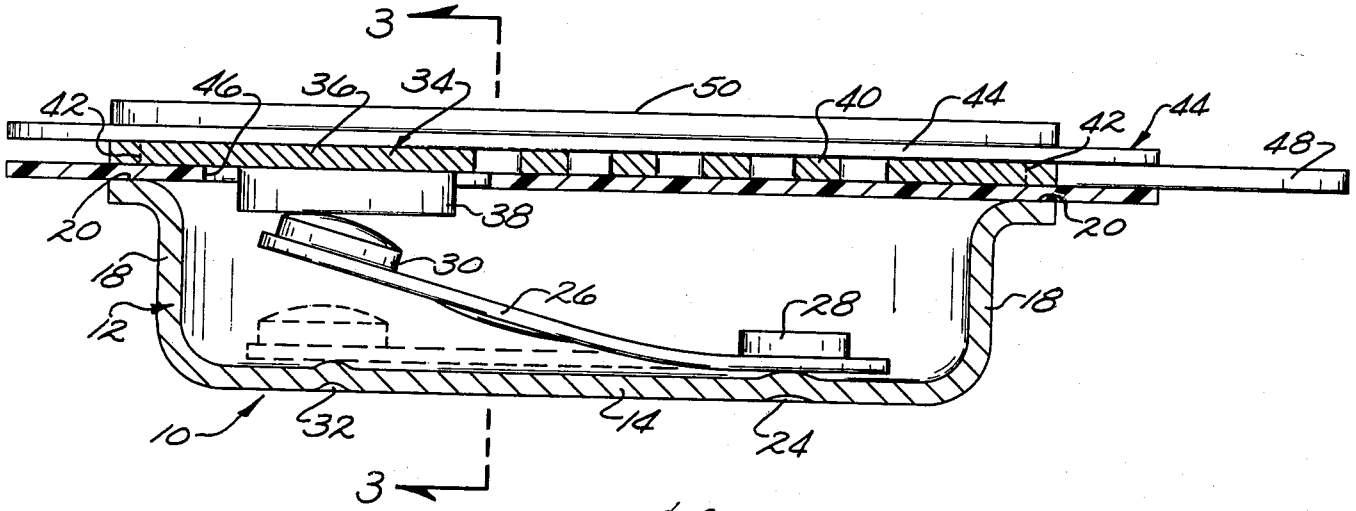
FIG. 2 is a cross sectional view taken along line 2—2 of FIG. 1.
Figure 3:
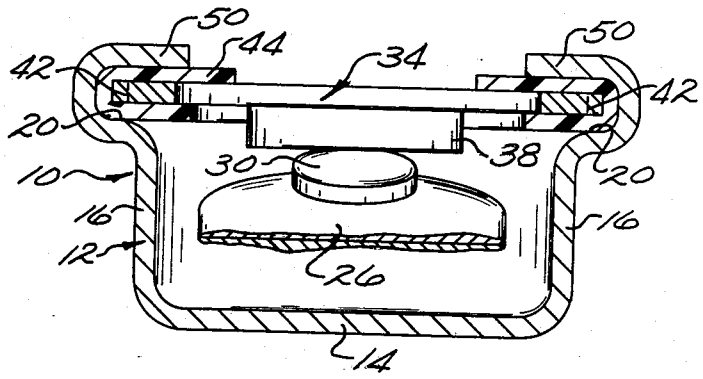
FIG. 3 is a cross sectional view taken along line 3—3 of FIG. 2.

Referring to the drawings, numeral 10 in FIGS. 1–3 indicates the protector made in accordance with the invention and which is shown to include a generally parallelepiped, open ended, electrically and thermally conductive metal can or housing 12 having a bottom 14 and depending opposed side walls 16 and end walls 18. Walls 16 and 18 have a free end formed into a ledge portion 20 extending around the open end of the housing. Preferably a portion 22 of the ledge extends from the housing to serve as an integral terminal. Side walls 16 are also preferably formed with portions 50 extending from ledge 20 to facilitate attachment of a gasket 44 and plate-like element 34 to be described below. Indentation 24 is preferably formed in the housing bottom to provide a weld projection inside the housing bottom, preferably using a conventional weld button 28 as shown in FIG. 2 so that the bimetal member extends in cantilever relation to the housing bottom to support a movable electrical contact 30 of conventional contact material at the distal free end of the bimetal member. The bimetal member 26 preferably has a dished portion intermediate its ends so that the member is adapted to move with snap action from a first position shown in solid lines in FIG. 2 to a second position shown in broken lines when the bimetal is heated to a selected actuating temperature. The bimetal member is also adapted to move with snap action back to said first position when the bimetal member subsequently cools to a relatively lower, reset temperature. Preferably an indentation 32 in the housing bottom provides a stop for limiting movement of the bimetal member as it snaps to the second broken line position. Alternatively of course other thermally responsive switch means of a conventional type may be incorporated within the protector for electrically connecting and disconnecting a circuit on the occurrence of an overload current or overtemperature condition in the protector.

Figure 4:
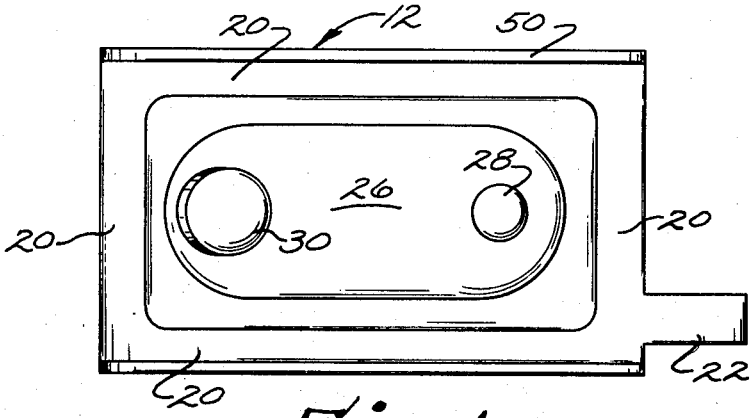
FIG. 4 is a top plan view of a protector housing useful in the FIG. 1 embodiment in which a thermostatic member has been disposed.
Figure 5:
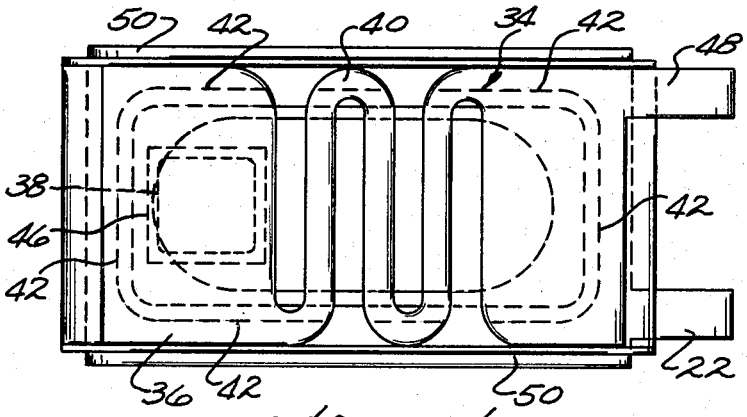
FIG. 5 is a view similar to FIG. 4 but showing the addition of a gasket and the three portion plate-like element mounting a portion of the switch and forming a heater for the protector.

The protector 10 also includes a generally flat, plate-like electrically conductive metal element 34 formed in three integral portions. The first portion 36 is generally rectangular in configuration and serves as a mounting portion for stationary contact 38, the second portion 40 is formed into a selected heater configuration while the third portion comprises an outer marginal berm indicated by dashed line 42. Berm 42 is adapted to contact ledge 20 on all four sides 16, 18 of the housing to provide a firm and rigid support for the entire element 34. Element 34 may be formed of any electrically conductive material having the desired resistance to function as a heater, such as nickel-iron, chromium-nickel, nickel-iron-aluminum, etc. As seen in FIG. 4 in which housing 12 is shown with thermostat member 26 disposed therein but without plate element 34, ledge 20 extends around the periphery of the open end of the housing. It will be noted that extension 50 of side walls 16 have not yet been bent over as shown in FIG. 3 but rather project upwardly generally in direction parallel to the side walls to facilitate assembly of disc 26 as well as gasket 44 and plate element 34. FIG. 5, similar to FIG. 4, shows the addition of electrically insulative gasket 44 placed on top of housing 12 and on top of which element 34 is disposed electrically separated from housing 12. Gasket 44 is formed of any suitable electrically insulative material capable of withstanding elevated temperatures such as polyethylene terephthalate. A window 46 is cut out of gasket 44 to permit stationary contact 38 to be exposed to the interior of the housing. As seen in FIG. 5, berm 42 is supported on ledge 20 on all four side walls of housing 12 to provide suitable support to obviate sagging of the heater or stationary contact. Such support is necessary since in miniature protectors of the type described herein a change in position of the stationary contact relative to the thermostatic member by as little as 0.002 inch can take the device completely out of calibration range as discussed supra. Firm support of the heater is also important in enhancing consistency of "on" times, that is that time necessary for heat to be transferred to the thermostatic member to raise it to its actuation temperature. It will be noted that in a device made in accordance with the invention even if the heater portion 40 were to warp, this would not effect the location of the switch element mounted on first portion 36 which is firmly supported on ledge 20.

In the FIGS. 1–5 embodiment heat is transferred to the thermostatic element primarily by means of conduction from portion 40 of element 34 to portion 36 and then through the stationary and movable contacts. If desired, window 46 of gasket 44 can be enlarged to permit more heat flow to the thermostatic member by radiation as well as conduction as described infra with reference to the embodiment shown in FIGS. 6 and 7.

Element 34 is also provided with an integrally formed tab 48 which serves as a terminal member. After placement of gasket 44 and plate element 34 on ledge 20 of housing 12 extensions 50 are bent over to clampingly attached the gasket and plate element to the housing to complete the protector asssembly.

Figure 6:
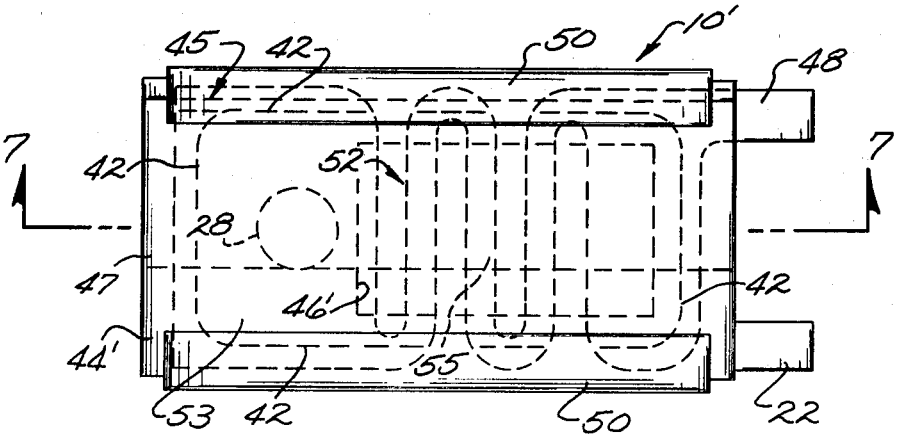
FIG. 6 is a view similar to FIG. 1 of a second embodiment of the invention.
Figure 7:
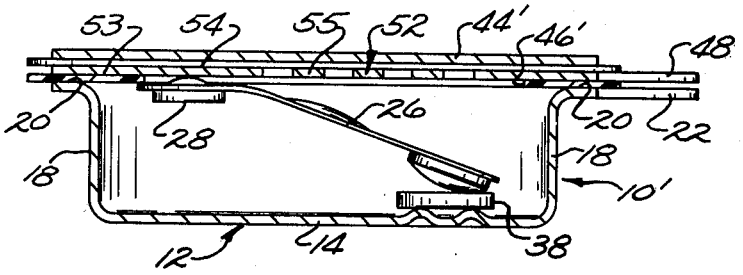
FIG. 7 is a cross sectional view taken on line 7—7 of FIG. 6.
Figure 8:
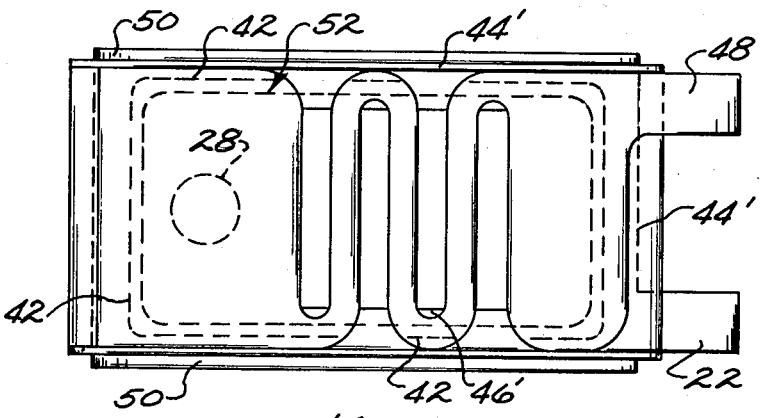
FIG. 8 is a view similar to FIG. 5 showing the three portion plate-like element used in the FIG. 6 embodiment.

In FIGS. 6–8 protector 10′ utilizes the same housing 12 however stationary contact 38 is welded to bottom wall 14 rather than to the plate like element 52 corresponding to plate element 34 in the FIGS. 1–5 embodiment while thermostatic member 26 is welded to a portion 54 of button 28 extending through the thermostatic member. As mentioned above, window 46′ is enlarged so that heat transfer to thermostatic element 26 is effected by radiation directly from portion 55 of plate element 52 as well as by conduction through first portion 53 of plate element 52. Gasket 44′ as seen in FIG. 6 is provided with sufficient width that when folded over and clamped by extension 50 of housing 12 it essentially closes the opening of housing 12 exteriorly of plate element 52 to facilitate encapsulation by conventional potting material if so desired. That is, edge 45 overlays edge 47 of the gasket and is clamped under extension 50.

Figure 9:
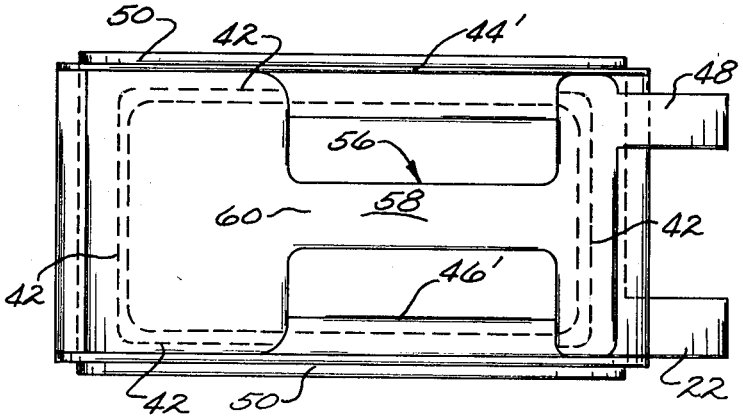
FIGS. 9–10 are views similar to FIGS. 5 and 8 of modified plate-like elements useful in the FIGS. 1 and 6 embodiments.
Figure 10:
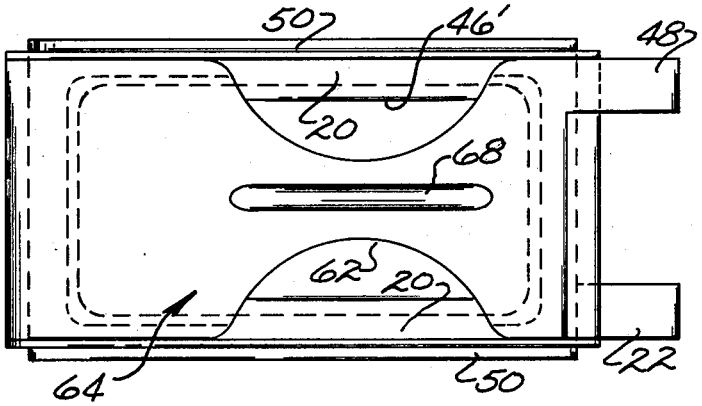

FIGS. 9–10 show several different heater configurations useful in the invention. The specific configuration will be selected based on specific objects to be obtained. That is, heaters of FIGS. 9 and 10 are more suitable for higher current applications compared to that shown for example in the range of 25–35 amperes. Further, in order to obtain a particular ratio of "on" to "off" times a selected heat profile may be chosen. For example, FIG. 10 shows a necked down heater configuration in second portion 62 of plate member 64 which is particularly effective for optimizing radiant heat flow to the bimetal disc. In this embodiment a rib 68 may be formed extending between opposite ends of plate 64 to ensure that no sagging occurs in portion 62.

Figure 11:
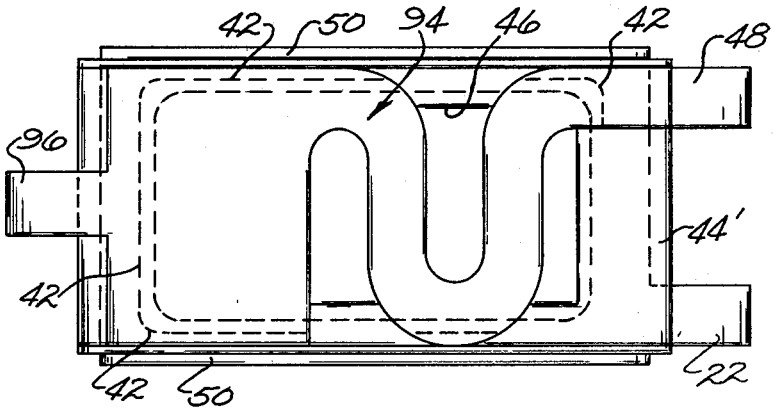
FIG. 11 is a view similar to FIGS. 5, 8, and 9–10 of a plate-like element modified to add a terminal to make it useful for both start and run winding motor protection.

FIG. 11 shows yet another plate member 94. Plate number 94 is provided with an additional terminal 96 adapted to be connected to a motor to provide a three terminal device for protection of both run and start windings in electrically connected thereto in a conventional manner.

It should be understood that preferred embodiments have been described by way of illustrating the invention but that this invention includes various modifications and equivalents of the disclosed embodiments. The invention includes all modifications and equivalents of the disclosed embodiments falling within the scope of the appended claims.

I claim:

1. A thermally responsive electrical circuit protector comprising an electrically and thermally conductive housing having a bottom wall and upstanding side walls with an open top, the side walls having free ends formed into a ledge portion, a generally flat plate like element disposed on the ledge portion with an electrically insulative gasket interposed therebetween to electrically separate the housing from the plate like element, means to clampingly attach the plate like element to the housing, heat responsive electrical switch means disposed in the housing adapted to connect and disconnect the housing and the plate like member upon the occurrence of selected thermal conditions and terminal means respectively attached to the housing and plate like member characterized in that the plate like element is formed with three integral portions, the first portion mounting a portion of the switch means, a second portion having a selected heater configuration and a third mounting portion adapted to be supported by the ledge portion of the housing.

2. A thermally responsive protector according to claim 1 in which the portion of the switch means mounted on the first portion of the plate like element is a stationary contact.

3. A thermally responsive protector according to claim 1 in which the portion of the switch means mounted on the first portion of the plate like element is a snap acting thermostatic member.

4. A thermally responsive protector according to claim 1 in which the electrically insulative gasket is formed with a cut out portion aligned with the said portion of the switch means, the gasket otherwise essentially closing the open end of the housing.

5. A thermally responsive protector according to claim 1 in which the electrically insulative gasket is formed with a cut out portion generally of a size and configuration corresponding to the opening of the open end of the housing.

6. A thermally responsive protector according to claim 1 in which the electrically insulative gasket is folded over the top of the plate like element and essentially encloses the outer surfaces of the plate like element.

7. A thermally responsive protector according to claim 1 in which the second portion of the plate like element is formed with a plurality of serpentine loops extending between and supported by the ledge on two opposite sides of the housing.

8. A thermally responsive protector according to claim 1 in which the second portion of the plate like element has two opposite ends with a necked down portion intermediate the two ends.

9. A thermally responsive protector according to claim 8 in which a strengthening rib is formed in the second portion of the plate like element extending in a direction between the two opposite ends.

10. A thermally responsive protector according to claim 2 in which the switch means includes a thermostatic member and heat is transferred from the second portion of the plate like element to the thermostatic member primarily by means of conduction through the stationary contact.

11. A thermally responsive protector according to claim 3 in which the electrically insulative gasket has a cut out portion aligned with the thermostatic member so that heat is transferred from the second portion of the plate-like element to the thermostatic member by radiation in addition to conduction.

12. A thermally responsive electrical circuit protector comprising an electrically conductive metallic housing generally shaped as a hollow parallelepiped with an open top, the housing having a bottom wall with four depending side walls terminating in free ends, the free ends formed into a ledge portion, a generally flat plate-like element disposed on the ledge portion with an electrically insulative gasket interposed therebetween to electrically separate the housing from the plate-like element, means to attach the plate-like element to the housing, heat responsive switch means disposed in the housing adapted to connect and disconnect the housing and the plate-like element upon the occurrence of selected thermal conditions, and terminal means respectively attached to the housing and plate-like element characterized in that the plate-like element is formed with a first portion mounting a portion of the switch means, a second portion having a selected heater configuration and a third mounting portion adapted to be supported by the ledge portion of the housing.

13. A thermally responsive protector according to claim 12 in which the portion of the switch means mounted on the first portion of the plate-like element is a stationary contact, the switch means including a thermostatic member with heat being transferred from the second portion of the plate-like member to the thermostatic member primarily by conduction through the stationary contact.

14. A thermally responsive protector according to claim 12 in which the portion of the switch means mounted on the first portion of the plate-like element is a snap acting thermostatic element with heat being transferred from the second portion of the plate-like member to the thermostatic member by radiation as well as conduction.

15. A thermally responsive protector according to claim 12 in which the second portion of the plate-like element is formed with a plurality of serpentine loops extending between and supported by the ledge on two opposite side walls of the housing.

* * * * *